US009351585B2

(12) United States Patent
Amann-Jennson et al.

(10) Patent No.: US 9,351,585 B2
(45) Date of Patent: May 31, 2016

(54) SLATTED BED FRAME WITH INTEGRABLE SHOULDER ZONE LOWERING DEVICE

(71) Applicant: SAMINA Produktions- & Handels GmbH, Frastanz (AT)

(72) Inventors: Guenther W. Amann-Jennson, Frastanz (AT); Elisabeth Amann, Frastanz (AT)

(73) Assignee: SAMINA PRODUKTIONS-& HANDELS GMBH, Frastanz (AT)

( * ) Notice: Subject to any disclaimer, the term of this patent is extended or adjusted under 35 U.S.C. 154(b) by 0 days.

(21) Appl. No.: 14/613,483

(22) Filed: Feb. 4, 2015

(65) Prior Publication Data

US 2015/0216316 A1 Aug. 6, 2015

(30) Foreign Application Priority Data

Feb. 5, 2014 (DE) ..... 10 2014 001 412

(51) Int. Cl.
*A47C 23/06* (2006.01)
*A47C 23/00* (2006.01)

(52) U.S. Cl.
CPC ..... *A47C 23/061* (2013.01); *A47C 23/06* (2013.01); *A47C 23/062* (2013.01)

(58) Field of Classification Search
CPC .... A47C 23/061; A47C 23/062; A47C 23/06; A47C 23/00
USPC ..... 5/236.1, 238, 241, 191, 731, 937
See application file for complete search history.

(56) References Cited

U.S. PATENT DOCUMENTS

| | | | | | |
|---|---|---|---|---|---|
| 54,737 | A * | 5/1866 | Jones | A47C 23/00 | 5/239 |
| 87,184 | A * | 2/1869 | Mattson | A47C 23/02 | 5/237 |
| 174,062 | A * | 2/1876 | Carter | A47C 23/02 | 5/237 |
| 187,961 | A * | 3/1877 | Burch | A47C 23/02 | 5/237 |
| 261,796 | A * | 7/1882 | Wells | 5/627 | |
| 2,349,839 | A * | 5/1944 | Apicella | F16F 1/18 | 267/165 |
| 2,638,606 | A * | 5/1953 | Austin | 5/239 | |
| 2,838,771 | A * | 6/1958 | Goodman | A47C 27/127 | 5/309 |
| 3,813,713 | A * | 6/1974 | Kipfer | A47C 23/067 | 297/283.2 |
| 4,222,134 | A * | 9/1980 | Degen | A47C 23/064 | 5/191 |

(Continued)

FOREIGN PATENT DOCUMENTS

| | | | |
|---|---|---|---|
| DE | 10343638 | A1 | 2/2005 |
| DE | 202011106023 | U1 | 1/2013 |

(Continued)

*Primary Examiner* — Robert G Santos
(74) *Attorney, Agent, or Firm* — Browdy and Neimark, PLLC

(57) ABSTRACT

A slatted bed frame having a plurality of upper and lower slats arranged transversely to a longitudinal axis of the bed frame, each slat being held at both ends by an elastic slat support and being spaced from the other slats, each of the slats forming a horizontal plane, with the upper slat plane forming a lying surface for a mattress pad, the lying surface being interrupted by a partial removal of at least one upper slat thereby forming at least one recess in the lying surface, into which at least one elastic insertion element, which forms a part of the lying surface, is arranged. In the region of the recess, a hanging insert is inserted, which is held at a distance from the lower slats.

9 Claims, 4 Drawing Sheets

(56) References Cited

U.S. PATENT DOCUMENTS 4,567,615 A * 2/1986 Fanti ..... A47C 23/068 267/160
4,638,517 A * 1/1987 Yang ..... A47C 23/06 5/191
5,070,560 A * 12/1991 Wilkinson ..... 5/710
5,280,658 A * 1/1994 Sigl ..... A47C 23/061 5/191
5,282,285 A * 2/1994 de Gelis ..... A47C 23/30 5/237
5,412,821 A * 5/1995 Wilkinson ..... 5/709
5,553,338 A * 9/1996 Amann ..... 5/236.1
5,916,086 A * 6/1999 Rossdeutscher ..... A47C 23/06 5/236.1
5,926,872 A * 7/1999 Rossdeutscher ..... A47C 23/06 5/236.1
6,073,281 A * 6/2000 Huber ..... A47C 23/068 5/236.1
6,161,234 A * 12/2000 Amann ..... 5/236.1
6,637,053 B1 * 10/2003 DiNapoli et al. ..... 5/236.1
6,668,397 B2 * 12/2003 Olenick et al. ..... 5/118
6,711,762 B2 * 3/2004 Olenick et al. ..... 5/118
2003/0140415 A1 * 7/2003 Olenick et al. ..... 5/118
2003/0140416 A1 * 7/2003 Olenick et al. ..... 5/118
2004/0148702 A1 * 8/2004 Husler ..... 5/236.1
2015/0216316 A1 * 8/2015 Amann-Jennson .. A47C 23/061 5/236.1

FOREIGN PATENT DOCUMENTS

EP 0385121 A1 9/1990
WO WO 9414359 A1 * 7/1994 ..... A47C 23/06

* cited by examiner

SLATTED BED FRAME WITH INTEGRABLE SHOULDER ZONE LOWERING DEVICE

FIELD

The invention relates to a slatted bed frame with an integrable shoulder zone lowering device.

BACKGROUND

According to sleep medicine recommendations, the orthopedically/anatomically correct positioning of the body during sleep is a critical factor for achieving healthy sleep. It is well known in the fields of sleep medicine and orthopedics that, in addition to the lumbar vertebral region, the shoulder zone in particular must be properly relieved of pressure and correctly stabilized during sleep.

The shoulder joint forms the movable connection between the shoulder blade and the humerus. Of all the ball-and-socket joints in the human body, the healthy shoulder joint has the greatest mobility, since it is secured primarily by the rotator cuff. Thus mobility is essentially unrestricted by the body framework. Moreover, the position of the entire shoulder joint can be changed by moving the shoulder blade. This allows the arm and the hand to be moved to many different positions, and to perform a very wide range of activities.

Statistics show that in Germany alone, 10-15% of adults suffer from chronic shoulder pain. Frequently this pain is caused by inflammatory disorders (omarthritis). Considerable pain and functional restriction can also be caused by impairment resulting from accident or degeneration. Another frequent complaint is irritation of the mucous membrane in the shoulder joint (Bursitis subacomealis). The orthopedic/anatomical lowering of the shoulder zone is of paramount importance for both regeneration of the shoulder zone and overall sleep quality.

In terms of mattress foundations, in orthopedic/anatomical terms, double-sided, preferably freely suspended slatted bed frames combined with a natural rubber mattress measuring 5.0-7.5 cm in thickness, and a virgin sheep's wool pad of proper weight for the climate where the bed is located have proven particularly advantageous.

A double-sided lamellar slatted bed frame is disclosed, for example, in EP 0 385 121 A1. The lying surface has an upper and a lower row of slats, arranged parallel to one another and connected to one another by elastic elements extending transversely to the slats, wherein the elastic elements have tabs on the top and bottom, into which slats can be inserted. The disadvantage of this known lying surface with two slat planes is that the heavy strain exerted by a heavyweight person sleeping on said surface results in an unfavorable distribution of pressure in the lying surface. Moreover, the slatted bed frame is not suitable for persons with shoulder disorders, since the pad surface is designed as having an even degree of hardness.

With double-sided slatted bed frames, it has likewise proven disadvantageous that the weight of the body in the shoulder region often results in excess counterpressure in the lower row of slats, which can lead to tension and circulation problems during sleep.

Studies and surveys have shown that approximately 60% of all people are side sleepers. This is the most popular sleeping position because it relieves pressure on the organs, the spine and the joints. Side sleepers who have broad, highly developed shoulders in particular need a flexible, automatically adjustable device for lowering the shoulder zone in order to relieve pressure on the cervical vertebrae and allow the shoulder region to sink into the mattress in accordance with orthopedic/anatomical requirements.

A number of structural mechanical and material-based shoulder zone lowering devices for double-sided slatted bed frames exist, which are designed for positioning the shoulder region properly in orthopedic terms. However, the shoulder zone adjustments offered by these devices do not function adequately from a sleep medicine and orthopedic standpoint. Such functional shoulder zones are particularly important for people whose shoulder joints are sensitive to pressure but who sleep primarily on their sides. This is the only way to prevent pain pulses that may disturb sleep, while at the same time promoting regeneration of the shoulder zone through the sleep process. In particular, people who suffer from acute or chronic shoulder problems such as calcific tendonitis of the shoulder, shoulder arthritis, impingement syndrome, tears in the rotator cuff, etc., or who suffer from sensitivity to pain following an accident and/or surgery are affected by this.

One prior solution involved removing approximately 5-6 slats from the upper row of slats in the shoulder region. The resulting opening, combined with the mattress and the mattress pad, enabled better yielding in the shoulder zone. At the same time however, during the sleep phase in which muscle tone decreases substantially the necessary stabilization and support of the highly mobile shoulder joint is lacking.

It is also possible to remove 5-6 slats in the shoulder region from the lower row of slats, closer to the floor. Although this reduces upward pressure in the region above the gap in the slats, it in turn leads to a decrease in the bearing pressure in the region of the shoulder. Thus one of the disadvantages is that, although the bearing pressure is reduced, the shoulder is not able to sink far enough downward. This disadvantage is perceptible particularly with more significant movements of the body, and can undesirably cause the sleeper to awaken if his shoulders are sensitive to pressure and pain.

Another known method consists in providing the slats of the shoulder region of the upper row of slats with thinner slats that have been cut with grooves or holes. This results in a decrease in the tensile force of the individual slats—and a reduction in bearing pressure. The disadvantage is that an effective adjustment to different body sizes, body types and especially different body weights is very expensive.

DE 103 43 638 B4 discloses a slatted bed frame which has a plurality of upper slats arranged transversely or perpendicular to a longitudinal axis of the frame, with each slat being held at both ends on a slat support or on a slat support section and forming a slatted bed frame/pad surface for a mattress pad. In the shoulder region, the slatted bed frame has a recess, in which an elastic element is arranged, which forms part of the slatted bed frame/pad surface and which is supported on the lower slat support or on the lower slats.

The elastic element can therefore be easily inserted into the resulting opening or recess and rests on the lower row of slats. A certain material-based softness factor can thereby be achieved. The disadvantage of this type of bearing is that it is often insufficient from an orthopedic standpoint, since such padded inserts react only passively to body movements and to the respective bearing pressure. As a result, the actual shoulder zone lowering device combined with the mattress resting thereon is inadequate in most cases, since a sturdier padding material will not allow the shoulder to sink far enough downward, and a softer padding material will produce an insufficient stabilizing and supporting effect.

One significant disadvantage of the embodiment according to DE 103 43 638 B4 is that no, or an insufficient, interactive connection between the elastic element and the slatted bed frame is provided. The elastic element is merely loosely placed in the opening produced by the removed slats, and rests flat on the lower row of slats. In addition, double-sided slatted bed frames physically exert a counterpressure upward due to the lower row of slats. This occurs particularly in the region of the lower back and in the shoulder region, where the bearing pressure is particularly high.

Placing the elastic element on the lower row of slats forces the elastic element upward toward the upper slats, which often prevents adequate yielding to the shoulder. Thus two hard transitions are produced—one between the elastic element and the slatted head section and one between the elastic element and the remaining, slatted lower part of the frame.

SUMMARY

The object of the present invention is therefore to provide a shoulder zone lowering device for double-sided slatted bed frames, which can be integrated and easily installed and with which an orthopedically/anatomically correct lowering of the shoulder zone in the side sleeping position, and also a correct positioning, stabilization and support in the back region is achieved.

The essential feature of the invention is that the slatted bed frame has at least one recess, in the region of which an insert can be suspended, which holds an elastic insertion element and keeps said element at a distance from the lower row of slats.

In a first preferred embodiment, the insert is embodied as a hanging pocket and is equipped at both of its ends in the longitudinal extension with loops, into which the upper slats can be inserted.

It is also possible for the hanging insert to have rubber straps or the like along its edge regions, with which a simple attachment to the adjacent row of slats is possible.

The hanging insert is preferably made of an elastic, preferably textile material. However, any other flexible material may also be used for the hanging insert.

Into the hanging insert, an insertion element can be inserted, which insertion element is also referred to in the following as a shoulder zone lowering device or textile insert. The insertion element is made of a soft, elastic material.

In a further preferred embodiment, the hanging insert and the insertion element form an integral part. Thus the insertion element has loops along each of its edge regions, via which a connection to the slats in the upper row of slats can be established.

The hanging insert is arranged together with the insertion element in the recess in such a way that these, together with the lying surface, form a flat surface. In a further embodiment example, the insertion element has a concave or convex curvature in relation to the lying surface.

The loop extends across the entire width of the recess, and at least one slat extends through the loop. However, it is also possible for a plurality of individual loops to be arranged across the width of the recess on the hanging insert, with at least one slat extending through each loop.

The recess in the slatted bed frame in the region of the upper row of slats is either formed in the factory or can be produced after-market by simply removing several upper slats. The hanging insert is then suspended in the last, upper row of slats before the recess, so that the textile insert forms a slightly sagging pocket for accommodating an insertion element.

The recess in the upper row of slats is preferably located in the shoulder region. However, it may also be located at another point along the longitudinal extension of the slatted bed frame, e.g. in the hip region. The number of recesses also is not limited to one. Of course, a plurality of recesses may also be arranged along the longitudinal extension of the slatted bed frame.

It would also be possible to arrange a plurality of recesses, across the width of the slatted bed frame, into which a hanging insert together with an elastic insertion element can then be inserted.

Of course, it is also possible to connect the hanging insert with its edge-side loops to a plurality of rows of slats in this manner. It also is not necessary for the hanging insert to be connected to the last row of slats before the recess; it may instead be connected to the second to the last row of slats before the recess, for example.

It is an essential advantage of the hanging insert that, with the compressive movements and tensile movements that occur during sleep as a result of body weight and body movements, an interactive, anatomically adjusted lowering and simultaneous stabilization of the shoulder zone is enabled.

The insertion element therefore not only lies in the recess, but is connected to the upper row of slats. Each time the body moves on the slatted bed frame, a compensating movement is simultaneously produced by means of the hanging insert in relation to the insertion element.

Thus an orthopedically correct positioning, stabilization and relief of pressure on the shoulder joint and the entire shoulder zone during sleep, especially in the side position, but also in the supine position, is achieved.

It is particularly advantageous that the hanging insert used (integrable shoulder zone lowering device) is freely suspended in the form of an elastic, padded textile element ("hammock principle") and does not rest on top of the lower row of slats.

This results in an automatic downward freedom of movement corresponding to that of the body structure and particularly the shoulder region, while at the same providing stabilization at the orthopedically correct point by the tension generated by the weight of the body, resulting in the desired relief of pressure on the shoulder joint and the shoulder zone while also enabling the necessary support and stabilization.

At the same time, fastening the integrable shoulder zone lowering device to the adjacent slats produces an optimal and flexible immediate adjustment of the shoulder zone in the event of major body movements such as turning from the side to the back and vice versa.

The weight of the sleeper's body in the side position automatically lifts up the edge regions of the integrable shoulder zone lowering device, those slats to which the tab is fastened tilt upward slightly under the resulting traction, optimally compensating for the difference in height between shoulder and head. The spinal column therefore remains in a straight, relaxed position, even in the critical region of the cervical vertebral column. When a sleeper turns over during the night from a side position onto his back or even to the prone position, this causes the integrable shoulder zone lowering device together with the slatted bed frame to return automatically to the orthopedically correct starting position.

It is further advantageous that the integrable shoulder zone lowering device corresponds to the interactions and the interplay between the slatted bed frame, natural rubber mattress and virgin sheep's wool pad and the body of the sleeper, particularly in the side position, where the bearing pressure in the shoulder region is correspondingly great.

Using a thin padding and filler layer, preferably made of virgin sheep's wool with a cover made of 100% cotton, also ensures high air permeability and good air and moisture exchange, which promotes a comfortable and healthy sleeping environment.

For optimal functioning of the integrable shoulder zone lowering device, surface-elastic, thin rubber mattresses are preferably used, so that no unnecessary and orthopedically undesirable counterpressure is produced in the shoulder region.

Due to the textile sections that are connected to the slatted bed frame, the integrable textile shoulder zone reacts like a sensitive sensor on the shoulder, back and neck regions of the sleeper to weight displacements, body shapes and changes in position.

Through the special "hammock technique", the integrable shoulder zone lowering device always yields with the proper intensity and provides flexible support at certain points in accordance with orthopedic/anatomic requirements. This elastic, padded textile insert absorbs every shoulder movement precisely, and compensates for each movement so as to avoid creating excess bearing pressure in the shoulder region—shoulder joints, shoulder musculature, tendons and ligaments are stabilized during sleep, while at the same time, circulation is not impaired. Thus better sleep quality can be achieved overall, especially an optimal regeneration of the entire shoulder, neck and spinal column region.

The subject matter of the present invention is derived not only from the subject matter of the individual claims, but also from the combination of individual claims with one another.

All specifications and features disclosed in the documents, including in the abstract, and in particular the configuration illustrated in the drawings are claimed as essential to the invention, to the extent that they are novel, alone or in combination, over the prior art.

BRIEF DESCRIPTION OF THE DRAWINGS

In the following, the invention will be specified in greater detail in reference to a set of drawings illustrating a plurality of embodiments. Additional features that are essential to the invention and advantages of the invention are also derived from the drawings and the description thereof.

The drawings show.

DETAILED DESCRIPTION

Figure 1A:
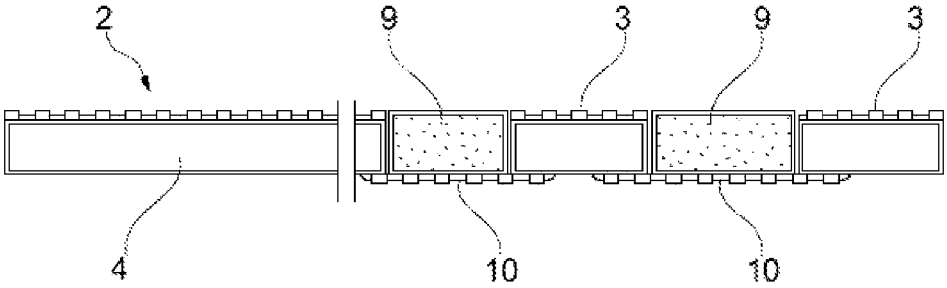
Fig. 1A Prior Art
FIG. 1A: a schematic representation of a slatted bed frame according to the prior art.

FIG. 1A shows a slatted frame 1 according to the prior art. The slatted bed frame 1 is preferably installed in a bed frame, with the bed frame consisting in a known manner of two side walls, parallel to one another, on the inner side of which are provided lateral ledges which extend accordingly along the periphery of the bed and on which the slatted bed frame 1 rests.

The slatted bed frame 1 consists of a plurality of upper and lower slats 3, 10, arranged parallel to one another. Slats 10 form the underside of the lying surface, whereas slats 3 form the upper side of lying surface 2.

To produce a spring effect in the lying surface, slat supports 4 are used, which extend, mutually spaced from one another and parallel to one another, in the direction of the longitudinal extension of the lying surface. Each slat support 4 is preferably square in cross-section with a square side length of approximately 8 cm.

A latex material or a textile material is preferably used as the material for slat support 4. Slat support 4 can be embodied as a strap, for example, which has a multiplicity of slide-in pockets along its longitudinal extension, into which upper and lower slats 3, 10 are inserted and held in place. Using slat support 4, slats 3, 10 can be aligned in relation to one another, both in the horizontal and in the vertical direction.

Each slat 3, 10 is preferably made of a solid wood material and is approximately 3 cm in width and approximately 8 mm thick, with each slat 3, 10 being arranged spaced from the others by approximately 10 cm. However, the slats may be made of a different material, for example plastic.

According to FIG. 1A, slatted bed frame 1 has individual recesses 6, 7, 8 along its longitudinal extension, into which an insertion element 9 can be inserted. The recess is produced by removing a number of upper slats 3. Insertion element 9 in this case always rests on a row of slats formed by lower slats 10.

Figure 1:
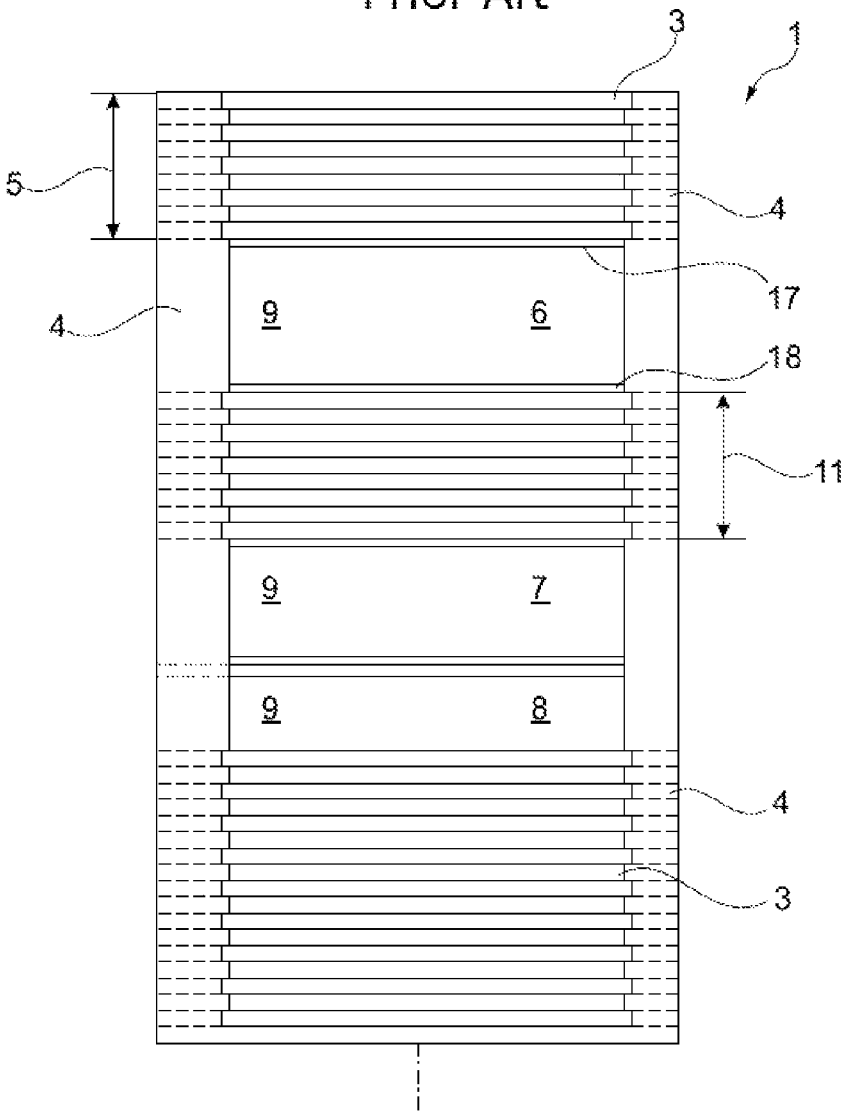
FIG. 1: a plan view of a slatted bed frame with recesses.

FIG. 1 shows slatted bed frame 1 according to the invention from a plan view. Slat supports 4 for slats 3, 10 extend along the longitudinal extension of slatted bed frame 1. Slats 3, 10 are preferably removably inserted into slat supports 4, and held in place there.

In a further embodiment, textile slat supports 4 can also be stitched to slats 3, 10 by means of thread.

Slatted bed frame 1 according to FIG. 1 has a row of slats 5 in the upper head region, which region is formed by at least 5 upper slats 3. This is followed along the longitudinal extension of slatted bed frame 1 by a recess 6, which is preferably located in the region of the shoulder of the person lying on the slatted bed frame 1. Recess 6 is embodied, for example, such that approximately 5-6 upper slats 3 are missing, while the lower slats 10 remain in this region (recess 6).

Recess 6 is followed by an additional row of slats 11, which is formed by at least 5-6 upper slats 3.

According to FIG. 1, additional recesses 7, 8 located, for example, at the level of the human hip or at the level of the human knee, are also provided along the longitudinal extension of slatted bed frame 1.

The edge region of recess 6 is formed by slats 17, 18, with slat 17 forming the upper edge region and slats 18 forming the lower edge region of recess 6.

An elastic insertion element 9 can preferably be inserted into recess 6, 7, 8, wherein said element is attached via a hanging insert 12, equipped with loops, to slats 17, 18 located along the edges.

Hanging insert 12 is preferably embodied as a hanging pocket, and is equipped at each of its ends, spaced from one another, with loop-type insertion openings, into which slats 17, 18 are inserted. Hanging insert 12 is made of a textile material and forms a slightly sagging pouch, which supports and holds insertion element 9 in the region of recess 6. The length of hanging insert 12 is chosen such that insertion element 9 is spaced from lower slats 10.

Hanging insert 12 can have additional fastening means, for example hook-and-loop tape fasteners, with which a detachable connection to insertion element 9 can be produced.

Figure 2:
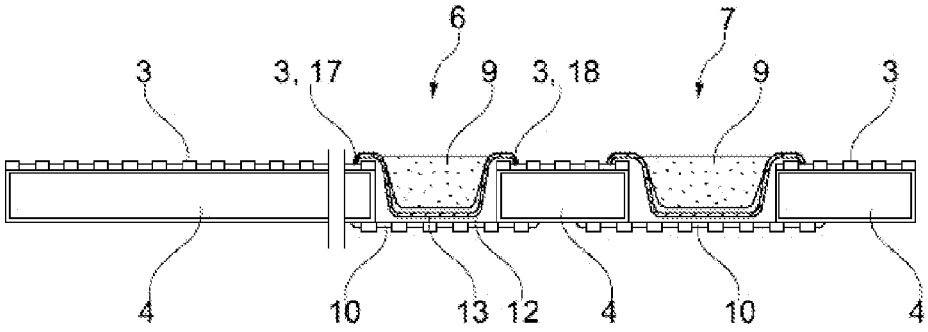
FIG. 2: a side view of the slatted bed frame, which is essential to the invention.

FIG. 2 shows slatted bed frame 1, considered essential to the invention, which has two recesses 6, 7 along its longitudinal extension in the region of upper slats 3.

A hanging insert 12 preferably has loops along its edge region, through which edge-side slats 17, 18 extend. Hanging insert 12 in this case is configured such that it forms a type of hanging mat in recess 6, and is spaced a distance 13 from lower slats 10.

The crucial feature is that the dimensions of hanging insert 12 are always such that the insert never comes into contact with lower slats 10.

In the embodiment according to FIG. 2, hanging insert 12 accommodates an elastic insertion element 9, and together the two form a shoulder zone lowering device.

Figure 3:
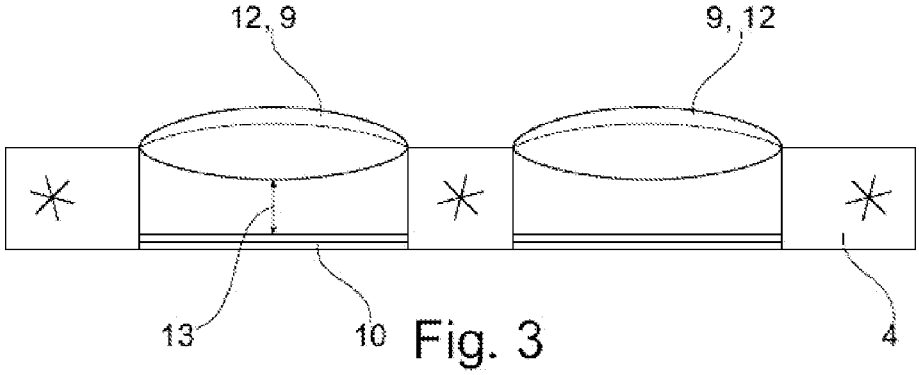
FIG. 3: a side view of the insert together with the insertion element.

FIG. 3 shows a further embodiment of the invention. In this case, hanging insert 12 and insertion element 9 are integral, and are arranged in a recess 6.

The crucial feature of all embodiments of the present invention is that hanging insert 12 is constantly held at a certain distance 13 from lower slats 10. This distance 13 is always large enough that, even when high pressure loads are applied to upper slats 3 or to insertion element 9, there is no contact between hanging insert 12 and lower slats 10.

Figure 4:
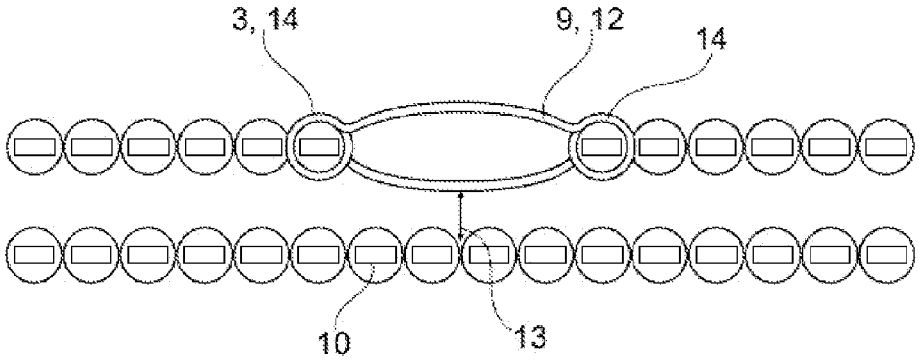
FIG. 4: a side view of the slatted bed frame together with the insertion element.

FIG. 4 illustrates the attachment 14 between upper slats 3 and hanging insert 12 and/or insertion element 9 in the region of a recess 6, 7, 8.

The attachment 14 is preferably accomplished by means of loops, which are securely connected to hanging insert 12 and through which upper slats 3 extend.

Of course, other options for an attachment 14 between hanging insert 12 and slats 3 may also be used. These may include a metal connection in the form of a clip or a rubber-like connection, for example.

The invention also is not restricted to an arrangement of attachment 14 on hanging insert 12. Of course, attachments 14 may also be arranged directly on insertion element 9.

Figure 5:
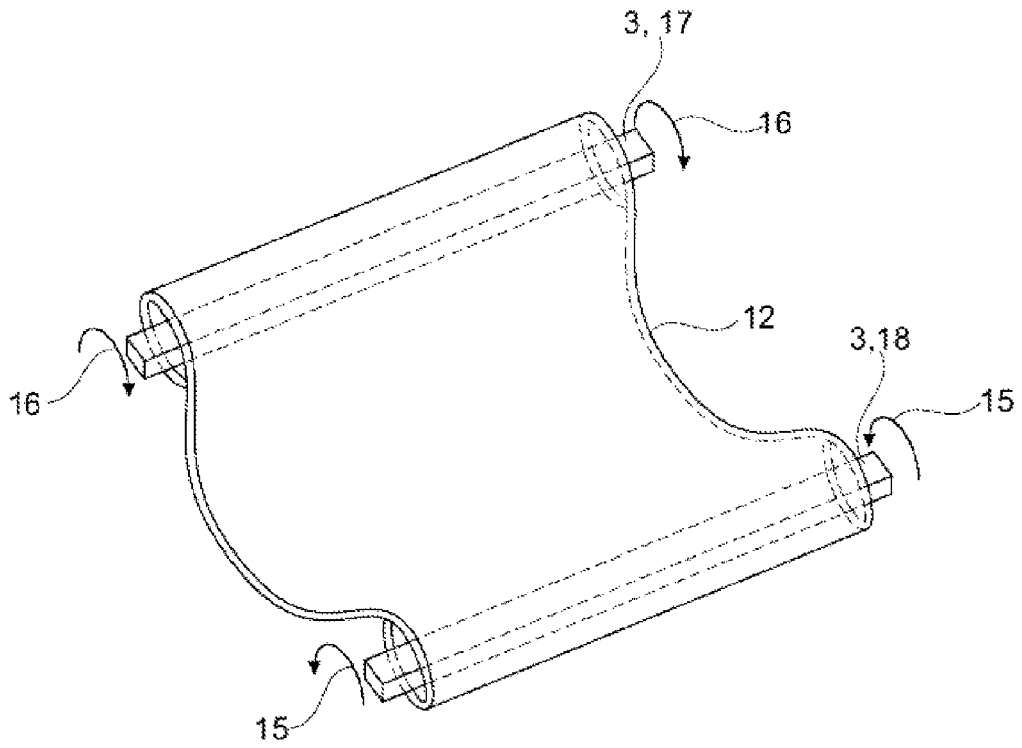
FIG. 5: a schematic representation of the hanging insert embodied as an unpadded cloth element in a recess, and FIG. 6 a schematic representation of the hanging insert embodied as a cloth element in a recess, said cloth element holding an elastic element.

FIG. 5 shows the compensating movement of upper slats 3 when pressure is applied.

A hanging insert 12, preferably made of a textile material, is suspended within recess 6. Because hanging insert 12 is connected to edge-side slats 17, 18, an interactive compensating movement is generated between the slats and insertion element 9.

Thus slats 3, 17, 18 move in the direction of arrows 15, 16 when a pressure force is exerted on hanging insert 12. This causes slats 3 to rotate downward with insertion element 9. As a result, the hard transition regions between edge-side slats 17, 18 and hanging insert 9 can be overcome for the first time.

If a compressive movement, for example, is then exerted on the row of slats 5 in the head region (cf. FIG. 1), this will cause the flexible slats 3, 17 to rotate upward in the direction opposite arrow 16, thereby lifting up hanging insert 12. The shoulder is therefore raised in the region of recess 6.

Figure 6:
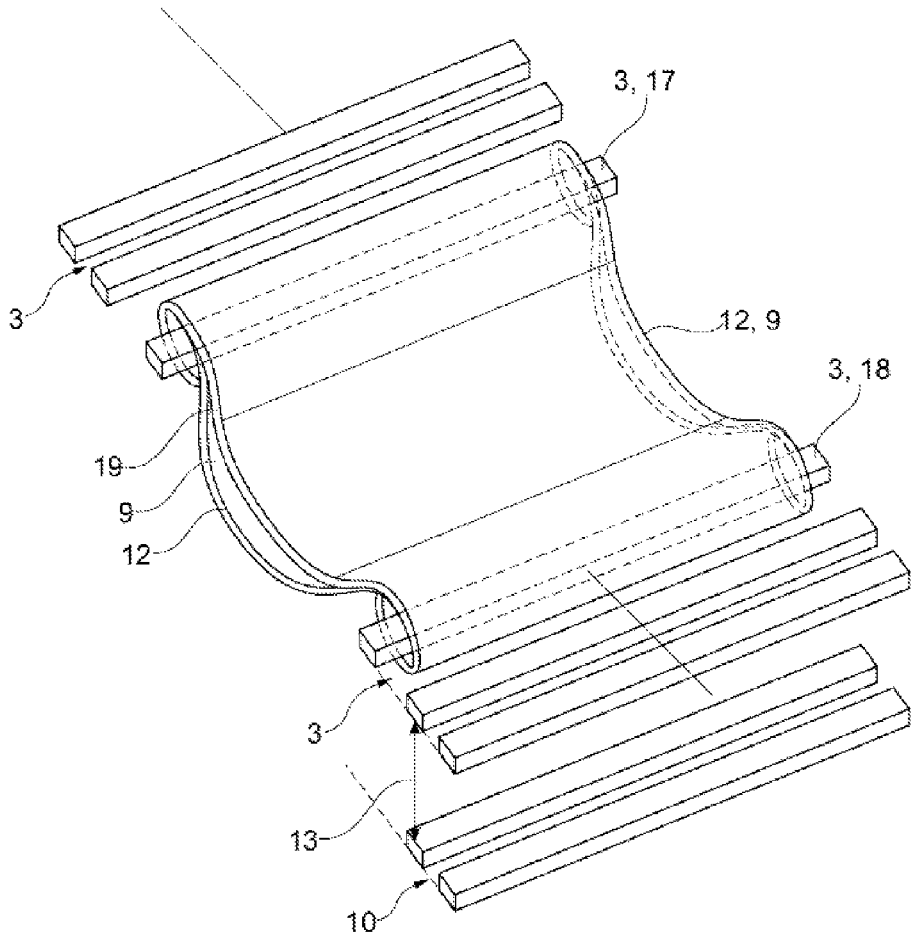

FIG. 6 shows hanging insert 12 together with insertion element 9, which together comprise padded or unpadded cloth elements that bridge the recess 6, 7, 8 in the manner of a hammock.

The two parts 9, 12 can be installed as accessory parts after-market into an existing slatted bed frame 1.

In the embodiment according to FIG. 6, the shoulder zone lowering device, which is formed by hanging insert 12 and insertion element 9, is made of a textile material that contains a filler material, comprising virgin sheep's wool or latex, for example.

The invention likewise claims protection for an accessory part for a slatted bed frame 1, embodied as a hanging insert 12 which remains constantly spaced from the lower slat plane 10 and which bridges the recess 6, 7, 8 in the lying surface (2) in a load-bearing manner.

Hanging insert 12 can comprise a padded or unpadded cloth element which bridges the recess 6, 7, 8 in the manner of a hammock.

LEGEND OF REFERENCE SIGNS

1 slatted bed frame
2 lying surface
3 upper slat
4 slat support
5 row of slats (head region)
6 recess (shoulder)
7 recess (center)
8 recess (lower)
9 insertion element
10 lower slat
11 row of slats in center section
12 hanging insert
13 distance between 9, 12 and 10
14 attachment
15 direction of movement
16 direction of movement
17 slat in upper edge region
18 slat in lower edge region
19 cloth cover

The invention claimed is:

1. A slatted bed frame comprising:

an upper frame portion formed by a plurality of upper slats arranged along an upper horizontal slat plane and forming a lying surface for a mattress pad, a lower frame portion formed by a plurality of lower slats arranged along a lower horizontal slat plane, the lower horizontal slat plane being spaced from and parallel to the upper horizontal slat plane, said upper and lower frame portions arranged transversely to a longitudinal axis of the bed frame and spaced from one another by a predetermined distance, at least one elastic slat support attached to respective ends of each slat of said plurality of upper slats and said plurality of lower slats, each slat of said plurality of upper slats and said plurality of lower slats being spaced from other slats in said plurality of upper slats and said plurality of lower slats, respectively, at least one recess defined in said lying surface by removal of at least one said plurality of upper slats such that the at least one recess separates a first slat and a second slat of said plurality of upper slats, said first and second slats being adjacent to one another, a hanging insert inserted in the at least one recess, said hanging insert being configured and sized to hang between the plurality of upper slats and the plurality of lower slats so as to maintain a distance from the plurality of lower slats in said lower frame portion, said hanging insert having a first end directly connected to only said first slat, a second end directly connected to only said second slat and longitudinal sides not connected to the bed frame; and an elastic insertion element inserted into said hanging insert in between the first and second slats, to form a part of the lying surface.

2. The slatted bed frame according to claim 1, wherein the hanging insert accommodates the elastic insertion element, which forms a bridge either in a flat plane or in a concave or convex shape over the at least one recess in the lying surface.

3. The slatted bed frame according to claim 1, wherein the hanging insert and the insertion element together form an integral part.

4. The slatted bed frame according to claim 1, wherein said hanging insert comprises loop-type insertion openings at said first and second ends, into which the first and second slats are inserted.

5. The slatted bed frame according to claim 1, wherein the insertion element provides softer support than the lying surface formed by the plurality of upper slats.

6. An accessory part for a slatted bed frame for the partial formation of a lying surface on a frame of slats, said accessory part comprising an insertion element which interrupts the lying surface of a plurality of upper slats arranged along an upper slat plane in the form of a recess and forms a partial lying surface for a body, wherein the insertion element is formed as a hanging insert, which is held constantly spaced from a plurality of lower slats arranged along a lower slat plane and which bridges the recess in the lying surface in a load-bearing manner, the lower slat plane being spaced from and parallel to the upper slat plane, the hanging insert having two ends, each of which is directly connected to only one of the plurality of upper slats via an attachment loop, the hanging insert also having longitudinal sides that are not to be connected to the bed frame.

7. The accessory part according to claim 6, wherein the hanging insert accommodates an elastic element.

8. The accessory part according to claim 6, wherein the hanging insert comprises a padded or unpadded cloth element that bridges the recess in the manner of a hammock.

9. The accessory part according to claim 6, wherein the hanging insert produces a connection between two of the slats in the upper slat plane.

* * * * *